United States Patent [19]

Vironda

[11] 3,983,654

[45] Oct. 5, 1976

[54] RELEASE TRIGGER MECHANISM

[76] Inventor: Italo D. Vironda, 194 N. Wabash, Battle Creek, Mich. 49017

[22] Filed: May 5, 1975

[21] Appl. No.: 574,310

[52] U.S. Cl. ..... 42/69 R; 42/69 B
[51] Int. Cl.[2] ..... F41C 19/00
[58] Field of Search ..... 42/69 R, 69 B, 41

[56] References Cited

UNITED STATES PATENTS

| | | | |
|---|---|---|---|
| 2,027,950 | 1/1936 | Young | 42/69 B |
| 2,033,803 | 3/1936 | Anderson | 42/69 R |
| 2,079,039 | 5/1937 | Razee | 42/69 B |
| 2,136,511 | 11/1938 | Jones | 42/69 R |
| 2,233,504 | 3/1941 | Young | 42/69 B |
| 2,406,980 | 9/1946 | Young | 42/69 R |
| 2,406,981 | 9/1946 | Young | 42/69 R |
| 2,626,476 | 1/1953 | Miller | 42/69 B |
| 2,654,175 | 10/1953 | Hansen | 42/69 B |

*Primary Examiner*—Charles T. Jordan
*Attorney, Agent, or Firm*—Woodhams, Blanchard and Flynn

[57] ABSTRACT

A release trigger arrangement for a firearm having a frame, a spring-loaded hammer mounted on the gun receiver and movable between a cocked position and a firing position and a movable, spring-loaded trigger for moving a sear out of such cocking engagement with the hammer against the urging of the spring-loading of the trigger. A first engagement member is mounted on the hammer. A second engagement member is mounted in spaced relation from the first engagement member when the sear is in cocking engagement with the hammer. The second engagement member is movable in response to a movement of the trigger against the urging of the spring-loading thereof into engagement with the first engagement member just prior to a release of the hammer by the sear to prevent a movement of the hammer to the firing position. The second engagement member is disengaged from the first engaging member in response to a movement of the trigger solely as a result of the spring-loading thereof.

8 Claims, 7 Drawing Figures

RELEASE TRIGGER MECHANISM

FIELD OF THE INVENTION

This invention relates to a trigger arrangement for a firearm and, more particularly, relates to a release trigger arrangement for a firearm generally utilizable in target shooting.

BACKGROUND OF THE INVENTION

This invention arose out of a need to improve existing release trigger arrangements for use in firearms generally utilized in target shooting, particularly trap and skeet shooting. It has been noted that many users of firearms will close their eyes involuntarily in response to a pulling or squeezing of a trigger on a firearm in expectation of the recoil offered by the firearm. This has a disruptive effect on the user's ability to maintain the firearm in proper alignment toward the target.

Thus, there has long existed a number of users of firearms, especially devotees of target shooting, who prefer to have the firearm discharged upon release of the trigger instead of the more usual pulling or squeezing thereof. Accordingly, the development of a very simplified construction is desirable for preventing the firing mechanism from moving from the cocked position to a firing position in response to a squeezing or pulling movement of the trigger and only thereafter permitting a movement of the firing mechanism to the firing position.

Therefore, it is an object of this invention to provide a release trigger arrangement which will prevent the firing of the firearm in response to a pulling or squeezing movement of the trigger and only thereafter permitting a movement of the firing mechanism to the firing position in response to a release of the trigger.

It is a further object of this invention to provide a release trigger arrangement which is simple and inexpensive to manufacture and simple to maintain in proper operating condition.

Further objects and purposes of this invention will be apparent to persons acquainted with release trigger arrangements upon reading the following specification and inspecting the accompanying drawing.

SUMMARY OF THE INVENTION

In general, the objects and purposes of the invention are met by providing a release trigger arrangement having a gun receiver means, a spring-loaded firing member mounted on the gun receiver means and movable between a cocked position and a firing position, a sear resiliently urged into cocking engagement with the firing member and a movable, spring-loaded trigger mounted on the gun receiver means for moving the sear out of such cocking engagement against the urging of the spring-loading of the trigger. A first engagement means is mounted on the firing member and a second engaging means is provided in spaced relation to the first engagement means when the sear is in cocked engagement with the firing member. The second engagement means is movable in response to a movement of the trigger against the urging of the spring-loading thereof into engagement with the first engagement means just prior to a release of the firing member by the sear to prevent a movement of the firing member to the firing position. The second engagement means becomes disengaged from the first engagement means in response to a movement of the trigger solely as a result of said spring-loading thereof.

Figure 1:
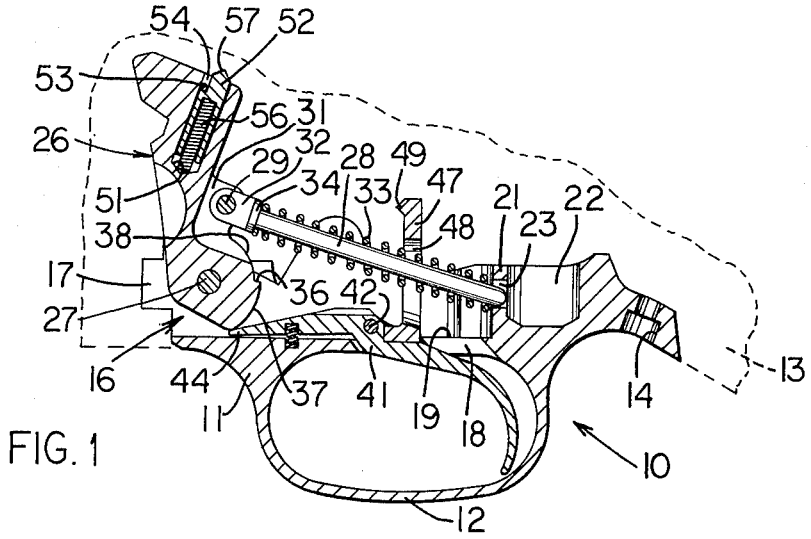
FIG. 1 is a central sectional view through a release trigger arrangement embodying my new invention and showing a hammer in the firing position.

Certain terminology will be used in the following description for convenience in reference only and will not be limiting. The words "up", "down", "right" and "left" will designate directions in the drawing to which reference is made. The words "in" and "out" will refer to directions toward and away from, respectively, the geometric center of the device and designated parts thereof. Such terminology will include the words above specifically mentioned, derivatives thereof and words of similar import.

DETAILED DESCRIPTION

Referring now to the drawing, a trigger arrangement 10 comprises a guard frame 11 having a trigger guard 12 thereon releasably secured to the receiver 13 of a firearm by any convenient type of securing means, such as a screw received into a hole 14 in the guard frame 11. The guard frame 11 has a generally U-shaped channel 16 having a pair of upstanding sidewalls, only one sidewall 17 being illustrated in FIGS. 1 to 3. An opening 18 is provided in the bottom wall 19 of the channel 16 to provide communication between the channel 16 and the area defined by the trigger guard 12. An upstanding wall 21 separates the channel 16 from a recess 22. An opening 23 is provided in the upstanding wall 21 to provide communication between the channel 16 and the recess 22.

A firing member, namely that member which effects firing in response to a trigger movement, here, and usually, the hammer 26 is positioned between the upstanding sidewalls of the channel 16 and is pivotally secured to the sidewalls by a pivot pin 27 which is secured to and extends between the aforementioned sidewalls. An elongated guide rod 28 is pivotally secured at one end to the hammer 26 by a guide rod pin 29. In this particular embodiment, the side of the hammer 26 facing the upstanding wall 21 has a recess 31 therein which receives an end 32 of the elongated guide rod 28, which end has an opening therethrough adapted to receive the aforementioned guide rod pin 29 which is secured to and extends between the sidewalls of the recess 31. The opposite end of the elongated guide rod 28 is received in the opening 23 in the upstanding wall 21. A hammer spring 33 is sleevably mounted over the elongated guide rod 28 and engages at one end an enlargement 34 on the guide rod 28 adjacent the end 32 and, at the other end, a surface of the upstanding wall 21 facing the hammer.

The hammer 26 also has a sear notch 36 thereon radially spaced from the pivot pin 27. The sear notch 36 is defined by the change in radical spacing between a pair of surfaces 37 and 38 on the hammer 26. In this particular embodiment, the surface 38 is spaced closer to the pivot pin 27 than is the surface 37.

Figure 6:
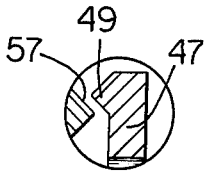
FIGS. 6 and 7 are enlargements of the encircled portions A and B in FIGS. 2 and 3, respectively.

A trigger mechanism 41 is received in the opening 18 in the guard frame 11 and is pivotally secured to the guard frame 11 by a pivot pin 42 which is secured to and extends between the sidewalls of the channel 16. A sear 43 is secured to the trigger mechanism 41 and a sear nose 44 thereon is placed in close proximity to the sear notch 36 on the hammer 26. A return spring 46 is positioned between the guard frame 11 and the sear 43 to urge the sear nose 44 into engagement with the surface 37 on the hammer 26 when the hammer is in the firing position (FIG. 1). In addition, a lever arm 47 is secured to the trigger mechanism 41 and extends generally at a right angle to the sear 43 between the firing member 26 and the upstanding wall 21. An opening 48 is provided in the lever arm 47 and receives the hammer spring 33 and the elongated pin 28 therethrough. A latching projection 49 is provided on the lever arm 47 adjacent its outer free end. The latching projection 49 is slightly inclined to the horizontal as best illustrated in FIG. 6. In this embodiment, the trigger 41 and sear 43 are a monolithic structure and the lever arm 47 is secured thereto, as by soldering.

A recess 51 is provided in the hammer 26 at a radially spaced location from the pivot pin 27. The longitudinal axis of the recess 51 intersects the lever arm 47 when the hammer is in the cocked position illustrated in FIG. 2. The importance of this geometrical relationship will be explained in detail below. A reciprocal pin 52 is received in the recess 51. The pin 52 has a stop surface 53 thereon which engages a stop pin 54 to prevent the removal of the pin 52 from the recess 51. The length of the pin 52 is less than the depth of the recess 51 and a spring 56 is positioned between the bottom of the recess 51 and the pin 52 to urge the pin, particularly the stop surface 53 thereon, into engagement with the stop pin 54. The outer end of the pin 52 which projects outwardly from the recess 51 defines a lip 57 slightly inclined to the horizontal engageable with the projection 49 on the lever arm 47 when the hammer 26 is in the cocked position.

OPERATION

Although the operation of the release trigger arrangement 10 will be understood by persons skilled in the art of release trigger arrangements, said operation will be described in detail hereinbelow for convenience.

Figure 2:
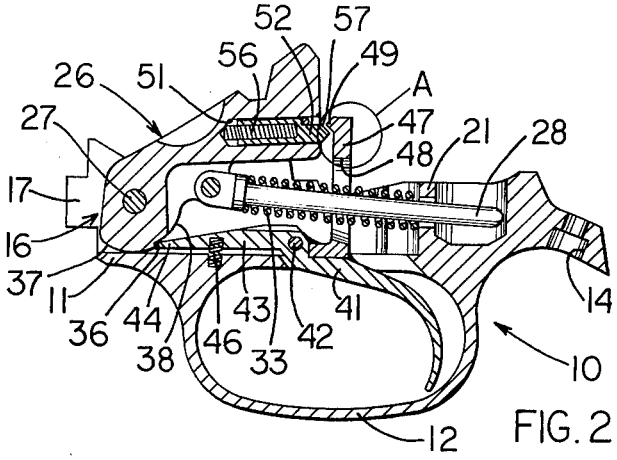
FIG. 2 is a central sectional view similar to FIG. 1 but showing the hammer in the cocked position.
Figure 7:
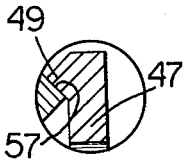

The hammer 26 is moved from the firing position illustrated in FIG. 1 to the cocked position illustrated in FIG. 2 by structure not illustrated in the drawing. Such cocking mechanism is well known in the art and a detailed discussion thereof is believed unnecessary. As the hammer 26 is pivoted about the axis of the pivot pin 27 toward the cocked position, the surface 37 will slide relative to the sear nose 44 until the sear notch 36 arrives at the free end of the sear nose 44 at which time the return spring 46 will urge the sear nose 44 into engagement with the surface 38 and the surface which defines the sear notch 36. Thus, the hammer 26 will be held in the position illustrated in FIG. 2 by the engagement of the sear nose 44 of the sear 43 in the sear notch 36 simultaneous with the release of the not illustrated cocking mechanism. As a result, the hammer spring 33 will be ineffective at this time to return the hammer 26 to the aforementioned firing position.

Figure 3:
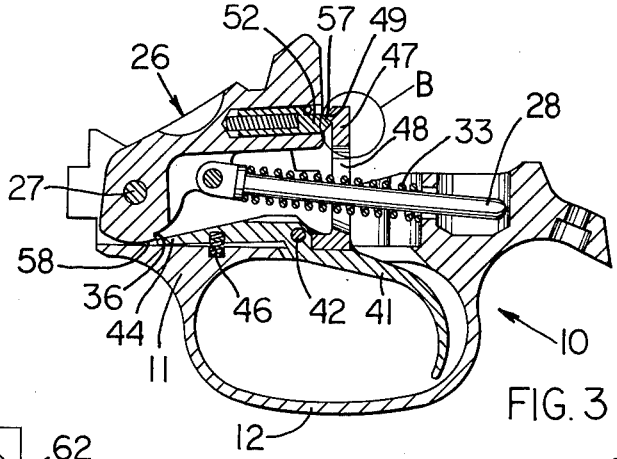
FIG. 3 is a central sectional view similar to FIGS. 1 and 2 but showing the trigger moved to a position whereat the sear is moved out of engagement with the sear notch on the hammer.

As indicated above, the longitudinal axis of the recess 51 intersects the lever arm 47. More specifically, the lip 57 on the pin 52 faces upwardly and slightly below the downwardly facing surface of the latching projection 49 on the lever arm 47. The spacing between the rightmost end of the upwardly facing surface of the lip 57 and the leftmost end of the downwardly facing surface of the latching projection 49 is very slight. As a result, a pivoting of the trigger mechanism 41 in a counterclockwise direction about the axis defined by the pivot pin 42 will simultaneously effect a movement of the sear nose 44 out of engagement with the sear notch 36 and a movement of the downwardly facing surface of the latching projection 49 into more of an overlapping relation with the upwardly facing surface of the lip 57. However, and prior to a release of the firing member 26 by reason of a disengagement of the sear nose 44 from engagement with the sear notch 36, the latching projection 49 is moved into a fully overlapping relation with the lip 57 to thereby prevent a movement of the hammer to the firing position at the moment in time when the sear nose 44 becomes disengaged from the sear notch 36 as illustrated in FIG. 3. A release of the user's pressure on the trigger mechanism 41 will permit the return spring 46 to urge the trigger mechanism 41 in a clockwise direction about the pivot pin 42. A small spacing 58 exists between the surface 37 on the hammer 26 and the upper surface of the sear nose 44. As a result, the latching projection 49 can move away from the lip 57 and the sear nose 44 can move toward the sear notch 36 but prior to the arrival of the sear nose 44 into engagement with the sear notch 36, the latching projection 49 will be freed of engagement with the lip 57 and the hammer spring 33 will then be effective to quickly move the hammer 26 to the firing position illustrated in FIG. 1.

ALTERNATE CONSTRUCTION

Figure 4:
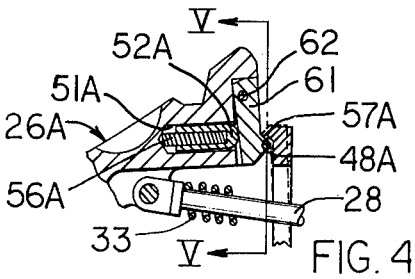
FIG. 4 is a fragmentary sectional view of a modified construction of my invention.
Figure 5:
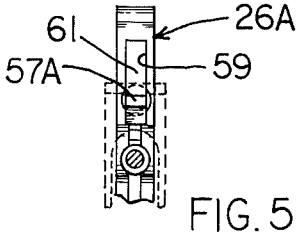
FIG. 5 is a sectional view taken along the line V—V of FIG. 4.

An alternate embodiment is illustrated in FIGS. 4 and 5. The frame 11 described above and the trigger mechanism 41 including the attachment of the elongated guide rod to the modified hammer 26A is identical to that described above and further discussion about the details thereof is believed unnecessary. For purposes of further discussion, however, the hammer 26A is identical to the firing member 26 described above except that the structure which defines the lip 57A is different from that described above. In addition, and as set forth immediately above, several of the reference numerals will be identical to those used in describing identical structure in FIGS. 1 to 3 and several of the other reference numerals will be identical except that the suffix A has been added thereto to indicate a modified construction.

More specifically, an elongated recess 51A is provided in the hammer 26A. A pin 52A is slidably received in the recess 51A and a spring 56A is positioned between the bottom of the recess 51A and the pin 52A to urge the pin 52A out of the recess 51A. A slot 59 is provided in the end of the hammer 26A overlapping the outer end of the recess 51A and extends transversely to the axis of the recess 51A. A hooklike member 61 is received in the slot 59 and is pivotally secured to the hammer 26A by a pivot pin 62 which is secured to and extends between the sidewalls of the slot 59. The hooklike member 61 has a surface defining a lip 57A. The hooklike member 61 is pivotal only to a limited extent due to the relative dimensioning of the slot 59 and the hooklike member 61. The lip 57A, like the lip 57, is inclined slightly to the horizontal in the direction of movement of the hammer toward the firing position.

The operation of the modified construction is identical to that described hereinabove, and, accordingly, further comment about the operation is believed to be unnecessary.

Although particular preferred embodiments of the invention have been disclosed in detail for illustrative purposes, it will be recognized that variations or modifications of the disclosed release trigger arrangement, including the rearrangement of parts, lie within the scope of the present invention.

The embodiments of the invention in which an exclusive property or privilege is claimed are defined as follows:

1. A release trigger arrangement for a firearm, comprising:

gun receiver means;

spring-loaded firing means mounted on said gun receiver means and movable between a cocked position and a firing position;

a sear resiliently urged into cocking engagement with said firing means;

a movable, spring-loaded trigger mounted on said gun receiver means for moving said sear out of such cocking engagement against the urging of said spring-loading of said trigger;

first engagement means on said firing means; and movable second engagement means movable in response to a movement of said trigger against said urging of said spring-loading thereof into a position blocking movement of said first engagement means just prior to a release of said firing means by said sear for preventing a movement of said firing means to said firing position, said second engagement means being movable from said blocking position with said first engagement means in response to a movement of said trigger solely as a result of said spring-loading thereof, said first engagement means including means defining a recess in said firing means, a spring member mounted in said recess and a movable member having a lip thereon biased by said spring member to a position wherein said lip is exposed for engagement by said second engagement means.

2. A release trigger arrangement according to claim 1, wherein said second engagement means includes a lever arm fixed to said trigger and having a projection thereon engageable with said first engagement means.

3. A release trigger arrangement according to claim 2, wherein said sear and said lever arm are movable as a unit with said trigger.

4. A release trigger arrangement according to claim 1, wherein said movable member is a pivotally supported lever pivoted into and out of said recess.

5. A release trigger arrangement according to claim 1, wherein said movable member is a hollow sleeve slidably reciprocally movable into and out of said recess.

6. A release trigger arrangement according to claim 1, wherein said firing means is a hammer.

7. A release trigger arrangement according to claim 6, wherein said second engagement means includes a lever arm fixed to said trigger and having a projection thereon engageable with said first engagement means;

wherein said sear and said lever arm are movable as a unit with said trigger;

wherein said hammer includes means defining a sear notch therein for receiving said sear therein to hold said hammer in said cocked position; and wherein said first engagement means includes means defining a recess in said hammer, a spring member mounted in said recess and a movable member having a lip thereon biased by said spring member to a position wherein said lip is exposed for engagement by said second engagement means.

8. A release trigger arrangement for a firearm, comprising:

gun receiver means;

spring-loaded firing means mounted on said gun receiver means and movable between a cocked position and a firing position;

a sear resiliently urged into cocking engagement with said firing means;

a movable, spring-loaded trigger mounted on said gun receiver means for moving said sear out of such cocking engagement against the urging of said spring-loading of said trigger;

movable first engagement means on said firing means and movable relative to said firing means; and movable second engagement means movable in response to a movement of said trigger against said urging of said spring-loading thereof into engagement with said first engagement means just prior to a release of said firing means by said sear to prevent a movement of said firing means to said firing position, said second engagement means becoming disengaged from said first engagement means in response to a movement of said trigger solely as a result of said spring-loading thereof.

* * * * *